US008616467B1

(12) United States Patent
Leavitt

(10) Patent No.: US 8,616,467 B1
(45) Date of Patent: Dec. 31, 2013

(54) SPRINKLER HEAD COVER

(76) Inventor: Gary Leavitt, Phoenix, AZ (US)

( * ) Notice: Subject to any disclaimer, the term of this patent is extended or adjusted under 35 U.S.C. 154(b) by 210 days.

(21) Appl. No.: 12/971,477

(22) Filed: Dec. 17, 2010

(51) Int. Cl.
*B05B 15/06* (2006.01)

(52) U.S. Cl.
USPC ..... 239/276; 239/288; 239/288.5

(58) Field of Classification Search
USPC ..... 239/288, 276, 288.5, 299.3, 299; 273/317
See application file for complete search history.

(56) References Cited

U.S. PATENT DOCUMENTS

| | | | | |
|---|---|---|---|---|
| 3,511,501 | A * | 5/1970 | Sandberg | 473/179 |
| 3,709,435 | A | 1/1973 | Sheets | |
| 4,014,502 | A | 3/1977 | Sheets | |
| 4,034,787 | A * | 7/1977 | Ellis | 607/113 |
| 4,429,832 | A | 2/1984 | Sheets | |
| 5,211,338 | A * | 5/1993 | Leite et al. | 239/276 |
| 5,308,075 | A * | 5/1994 | Theriault | 473/279 |
| 5,678,353 | A | 10/1997 | Tsao et al. | |
| 5,915,879 | A * | 6/1999 | Burnett et al. | 405/116 |
| 5,931,385 | A | 8/1999 | Miller | |
| 6,439,476 | B1 * | 8/2002 | Boggs | 239/203 |
| 6,575,628 | B1 * | 6/2003 | Borchardt et al. | 383/64 |
| 7,337,585 | B1 * | 3/2008 | Bobbit | 52/128 |
| 2004/0211129 | A1 | 10/2004 | Sannipoli, Sr. et al. | |

FOREIGN PATENT DOCUMENTS

| | | | | |
|---|---|---|---|---|
| GB | 2449895 | | 10/2008 | |
| JP | 7300871 | | 11/1995 | |
| JP | 1119266 | A * | 1/1999 | A63B 69/36 |

* cited by examiner

*Primary Examiner* — Jason J Boeckmann
*Assistant Examiner* — Joel Zhou
(74) *Attorney, Agent, or Firm* — Adam R. Stephenson, Ltd.

(57) ABSTRACT

A sprinkler head cover. Implementations may include an artificial turf portion including a backing, a stiffener coupled to the backing, and a bag coupled to the stiffener where the bag has at least one reclosable opening therein. The bag may be configured to receive a quantity of fill material when the at least one reclosable opening is opened and to retain the quantity of fill material within the bag when the at least one reclosable opening is closed. The bag may also be configured to rest on a top surface of a sprinkler head when the sprinkler head is in a retracted position in a grassy area.

16 Claims, 3 Drawing Sheets

SPRINKLER HEAD COVER

BACKGROUND

1. Technical Field

Aspects of this document relate generally to devices and systems utilized in association with watering systems included in grassy areas, such as golf courses and lawns.

2. Background Art

Many conventional golf courses generally include several holes that are formed of grassy areas of varying grass types mowed to different heights that form rough, fairway, and green areas of a hole. Live grass is used in most conventional golf courses to form the grassy areas, and to maintain the specialized grass types used in each area of a golf course hole, particularly the green, an automatic watering system including sprinkler heads is often used. In grassy areas in parks and lawns, automatic watering systems may also be used, particularly in drier climates. Conventional sprinkler heads used in golf courses and lawns are included in a hole or depression in the grassy area and extend from ground level when water pressure is applied during operation and subsequently retract into the ground when the flow of water stops. A wide variety of conventional sprinkler types, sizes, and methods of operation may be utilized in various golf courses and lawns.

SUMMARY

Implementations of sprinkler head covers like those disclosed herein may include an artificial turf portion including a backing, a stiffener coupled to the backing, and a bag coupled to the stiffener where the bag has at least one reclosable opening therein. The bag may be configured to receive a quantity of fill material when the at least one reclosable opening is opened and to retain the quantity of fill material within the bag when the at least one reclosable opening is closed. The bag may also be configured to rest on a top surface of a sprinkler head when the sprinkler head is in a retracted position in a grassy area.

Implementations of sprinkler head covers may include one, all, or any of the following:

One or more spikes may be included which are slidably retained between the stiffener and a spike retainer coupled to the stiffener where the one or more spikes extend through one or more spike openings in the bag.

The at least one reclosable opening may include a fastener selected from the group consisting of hook and loop fasteners, a zipper, one or more snaps, and one or more buttons.

The artificial turf portion may further include a plurality of fibers coupled to the backing where the plurality of fibers may further include an image thereon.

The fill material may be selected from the group consisting of sand, lead shot, steel shot, and gravel.

Implementations of a sprinkler head cover may include an artificial turf portion including a backing where the artificial turf portion is configured to be substantially coextensive with an area of a hole including a sprinkler head in a grassy area. A stiffener may be included coupled to the backing a first side of the stiffener and a back may be coupled to the stiffener on a second side of the stiffener. The bag may have at least one reclosable opening therein. The bag may also be configured to rest on a top surface of the sprinkler head.

Implementations of sprinkler head covers may include one, all, or any of the following:

One or more spikes may be included and may be slidably retained against the second side of the stiffener and against a spike retainer coupled to the stiffener. The one or more spikes may extend through the one or more spike openings in the bag and may be configured to engage with soil around the sprinkler head.

The at least one reclosable opening may include a fastener selected from the group consisting of hook and loop fastener, a zipper, one or more snaps, and one or more buttons.

The artificial turf portion may further include a plurality of fibers coupled to the backing where the plurality of fibers further includes an image thereon.

The fill material may be selected from the group consisting of sand, lead shot, steel shot, and gravel.

Implementations of sprinkler head covers may be utilized in implementations of a method of covering a sprinkler head. The method may include opening a reclosable opening in a bag included in a sprinkler head cover where the sprinkler head cover includes a stiffener coupled to a backing of an artificial turf portion and where the bag is coupled to the stiffener. The method may further include placing fill material within the bag, closing the reclosable opening, and placing the bag within a hole containing a sprinkler head in a retracted position where the hole is included in a grassy surface.

Implementations of a method of covering a sprinkler head may include one, all, or any of the following:

The method may include adjusting a height of the artificial turf portion above the sprinkler head by removing the sprinkler head cover from the hole, opening the reclosable opening, adding additional or removing fill material from the bag, closing the reclosable opening, and replacing the bag within the hole.

The method may include engaging one or more spikes included in the sprinkler head cover with soil around the sprinkler head.

The method may also included adjusting the position of the one or more spikes by sliding the one or more spikes away or toward an outer edge of the sprinkler head cover where the one or more spikes are slidably engaged between the stiffener and a spike retainer coupled to the stiffener.

The method may include adjusting a height of the artificial turf portion above the sprinkler head by pressing downwardly on the sprinkler head cover to push the one or more spikes into the soil until the artificial turf portion is substantially at the level of grass surrounding the sprinkler head.

The method may also include applying an image to a plurality of fibers included in the artificial turf portion.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended sprinkler head cover and/or assembly procedures for a sprinkler head cover will become apparent for use with particular implementations from this disclosure. Accordingly, for example, although particular implementations are disclosed, such implementations and implementing components may comprise any shape, size, style, type, model, version, measurement, concentration, material, quantity, and/or the like as is known in the art for such sprinkler head covers and implementing components, consistent with the intended operation.

Figure 1:
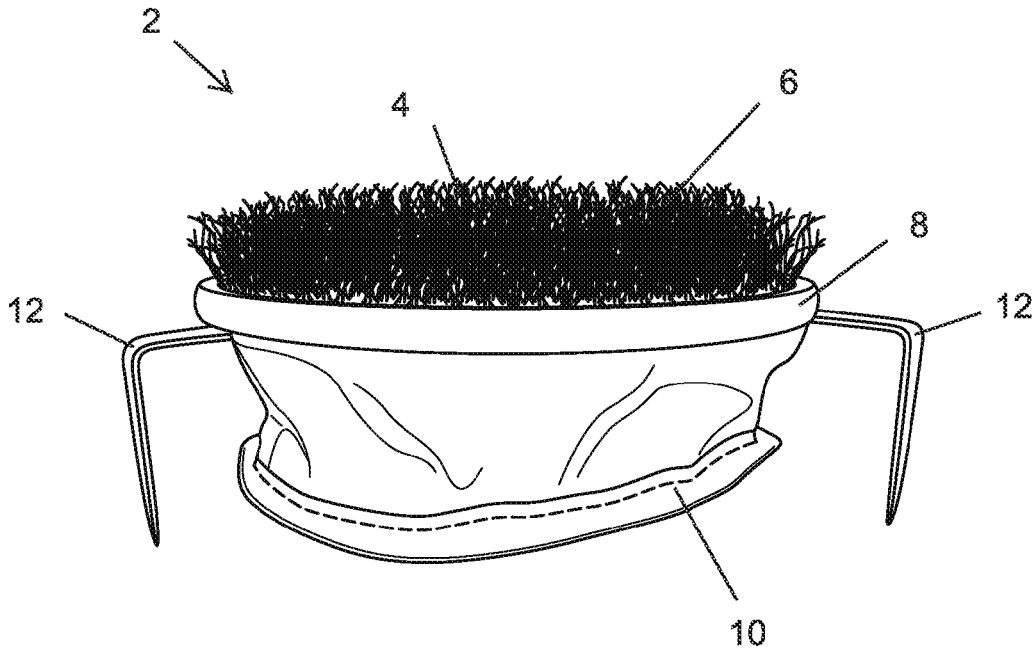
FIG. 1 is a side view of an implementation of a sprinkler head cover.

Referring to FIG. 1, an implementation of a sprinkler head cover 2 is illustrated. As illustrated, the cover 2 includes an artificial turf portion 4 that includes a plurality of fibers 6. Coupled to the artificial turf portion 4 over an edge 8 of the artificial turf portion 4 is a bag 10 made of any of a wide variety of fabric materials, including, by non-limiting example, polyesters, nylons, acrylics, polyolefins, rayon, acetate, aramids, and any other synthetic or natural fiber. As illustrated, in particular implementations, one or more spikes 12 may extend through openings in the bag 10 and include pointed ends that face away from the artificial turf portion 4.

Figure 3:
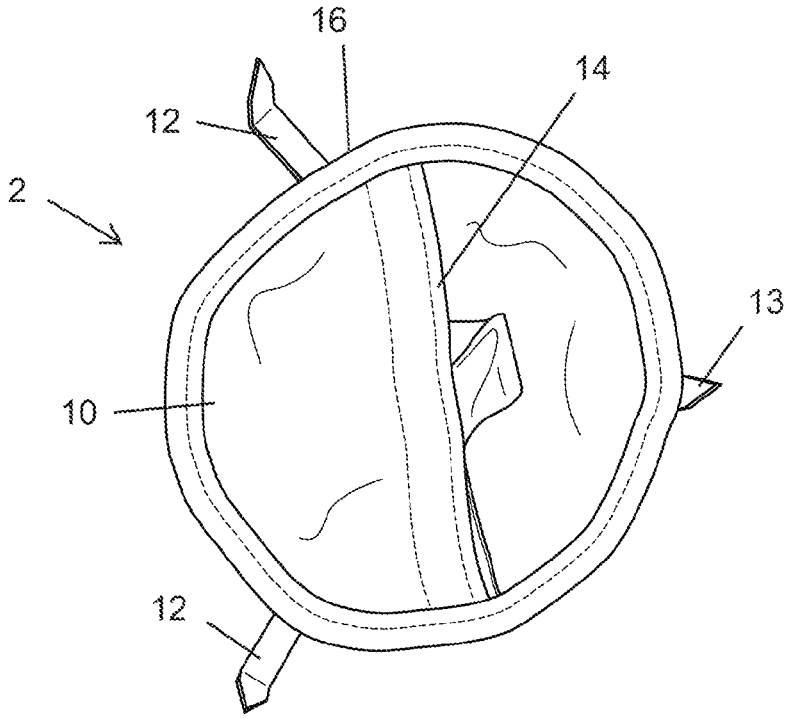
FIG. 3 is a bottom view of an implementation of a sprinkler head cover.

Referring to FIG. 3, a bottom view of the implementation of a sprinkler head cover 2 is illustrated. As illustrated, the cover 3 may include three spikes 12, 13 that may be arranged equal distances from each other along a circumference of the cover 2. While three spikes 12, 13 are illustrated, fewer or more spikes may be utilized in particular implementations. As will be discussed in more detail later in this document, the one or more spikes may be slidable and slidably coupled to the sprinkler head cover 2. As illustrated, spike 13 is in a retracted position while spikes 12 are slidably extended from an outer edge 16 of the cover 2 and are in an extended position.

While the implementation of a cover 2 illustrated in FIGS. 1 and 3 is substantially circular, other sprinkler head cover implementations may have any other desired shape, including, by non-limiting example, oval, elliptical, square, rectangular, triangular, or any other closed shape. As illustrated, the bag 10 may include at least one reclosable opening 14 therein. In the implementation illustrated, one reclosable opening 14 that bisects a majority of the bottom surface of the bag is included an is in a closed position. In other implementations, however, more than one reclosable opening could be included; multiple reclosable openings could be utilized, for example, when the bag consists of several internal compartments joined together.

Figure 4:
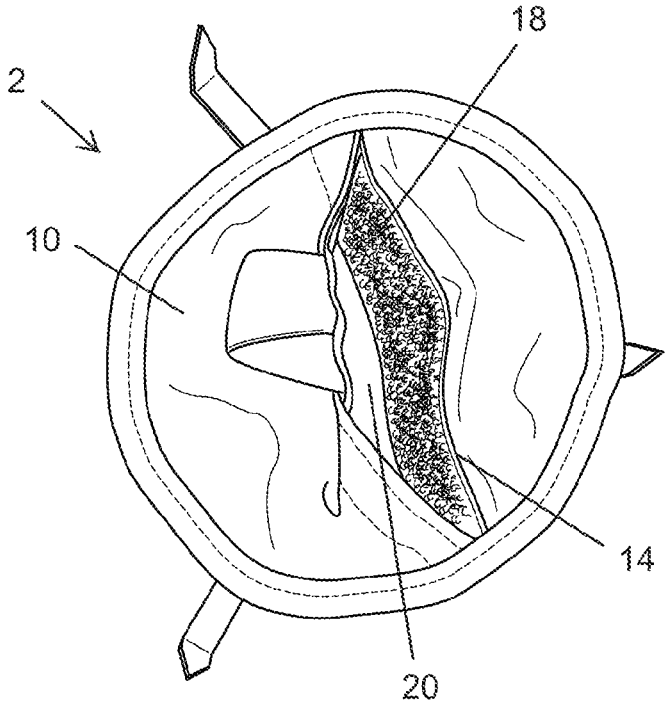
FIG. 4 is a bottom view of an implementation of a sprinkler head cover showing a reclosable opening in an open position.
Figure 5:
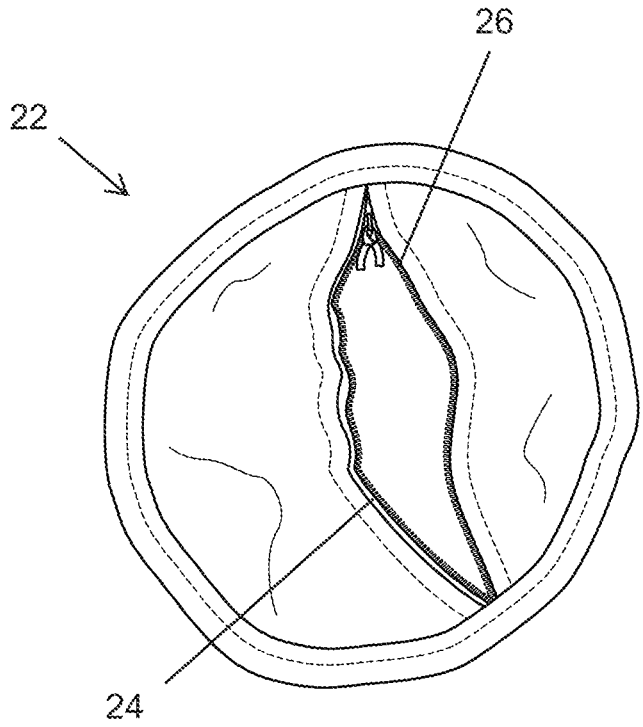
FIG. 5 is a bottom view of another implementation of a sprinkler head cover showing a reclosable opening in an open position.

FIG. 4 illustrates the sprinkler head cover 2 with the reclosable opening 14 in an open position revealing the interior cavity 20 enclosed by the bag 10. As illustrated, the reclosable opening 14 can be closed using hook and loop fastener 18, which may, in particular implementations, be that manufactured and marketed under the tradename Velcro® by Velcro USA, Inc. of Manchester, N.H. As illustrated in FIG. 5, other implementations of sprinkler head covers 22 may include a reclosable opening 24 that utilizes a zipper 26 to close the opening. In other implementations, a wide variety of other fastener types may be utilized, including, by non-limiting example, snaps, buttons, adhesives, or any other structure or system adapted to hold two fabric portions together.

In particular implementations of sprinkler head covers 22, no spikes may be included, as in the implementation illustrated in FIG. 5. In other implementations of sprinkler head covers, however, a reclosable opening and/or a bag may not be included, and only spikes may be utilized. A wide variety of implementations are possible using the principles disclosed in this document.

Figure 6:
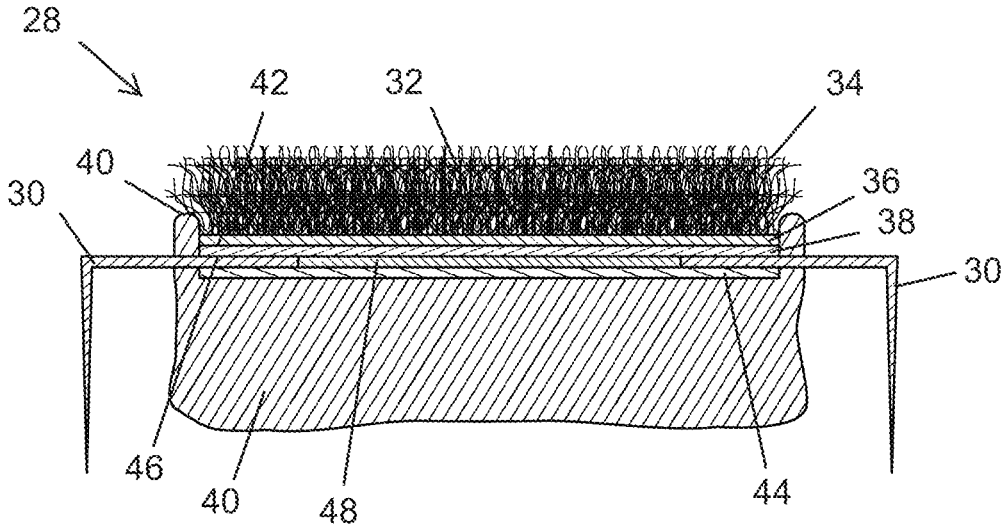
FIG. 6 is a cross section view of another implementation of a sprinkler head cover.

Referring to FIG. 6, a cross section view of another implementation of a sprinkler head cover 28 is illustrated. The cover 28 illustrated in FIG. 6, includes four spikes 30, each arranged as opposing pairs with one spike 30 on a side of the cover 28 and linearly aligned with each other. The cross section view taken in FIG. 6 is through the center of a pair of spikes 30. The cover 28 includes an artificial turf portion 32 that includes a plurality of fibers 34 coupled to a backing 36. The artificial turf portion 32 may be any of wide variety of conventional artificial grass types and may not include infill material. The backing 36 is coupled to a stiffener 38 to which the bag 40 is also coupled. The bag 40 may be coupled to the stiffener through any of a wide variety of techniques, including, by non-limiting example, sewing, gluing, thermal bonding, screwing, or any other coupling technique. In the implementation illustrated in FIG. 6, the fabric of the bag 40 is brought up over the edges 42 of the stiffener 38 and the artificial turf portion 32, placed against a first side 40 of the stiffener 38, and then sewn to the stiffener 38.

In implementations of covers 28 that include spikes 30, the spikes 30 may be slidably coupled to or within the cover 28 through use of a spike retainer 44 that is coupled to the stiffener 38. The spikes 30 may be retained against a second side 46 of the stiffener 38 and the spike retainer 44, allowing them to slide in a space 48 located between the stiffener 38 and the spike retainer 44. A wide variety of structures and systems may also be employed to prevent the spikes 30 from sliding all the way out of the cover 28. In a particular implementation, the stiffener may include a slot in which a screw is inserted that screws into a spike. Because the head of the screw is wider than the slot, the spike may be able to slide back and forth a distance substantially equal to the length of the slot (minus the width of the screw) while the screw prevents the spike from sliding past the end of the slot. In another implementation, the end of the spike within the cover may be curved toward the stiffener or toward the spike retainer. Because of the curve in the spike, the spike cannot fully slide out from between the stiffener and the spike retainer. In such an implementation, the spike retainer may take the form of a ring and the curved portion of the spike may not be able to through the gap between the edge of the ring-shaped spike retainer and the stiffener. A wide variety of other structures and systems may be utilized in various implementations of sprinkler head covers to retain various spike implementations.

The artificial turf portion 32, the stiffener 38, and the spike retainer 44 may be coupled together through a wide variety of structures and systems in various implementations. In a particular implementation, a single screw may be inserted through the artificial turf portion, the stiffener, and the spike retainer and serve to hold all three portions together. In others, the artificial turf portion 32, the stiffener 38, and the spike retainer 44 may be coupled together collectively or as individual pairs through, by non-limiting example, gluing, thermal bonding, sewing, hook and loop fasteners, screws, snaps, or any other structure or method of coupling two planar pieces together.

A wide variety of materials may be utilized in various implementations of sprinkler head covers 2, 22, and 28 disclosed herein. In a particular implementation, the fabric of the bag may be a 1000 D thread sized nylon marketed under the tradename Cordura® by INVISTA S.à.r.l. of Wichita, Kans. The stiffener may be 0.093" thermoplastic marketed under the tradename Kydex by KYDEX, LLC of Bloomberg, Pa. The spikes may be made of ¾" galvanized steel strap. A wide variety of other materials, such as, by non-limiting example, wood, rubbers, composites, ceramics, plastics, and any other desired material may be utilized in various implementations.

Figure 2:
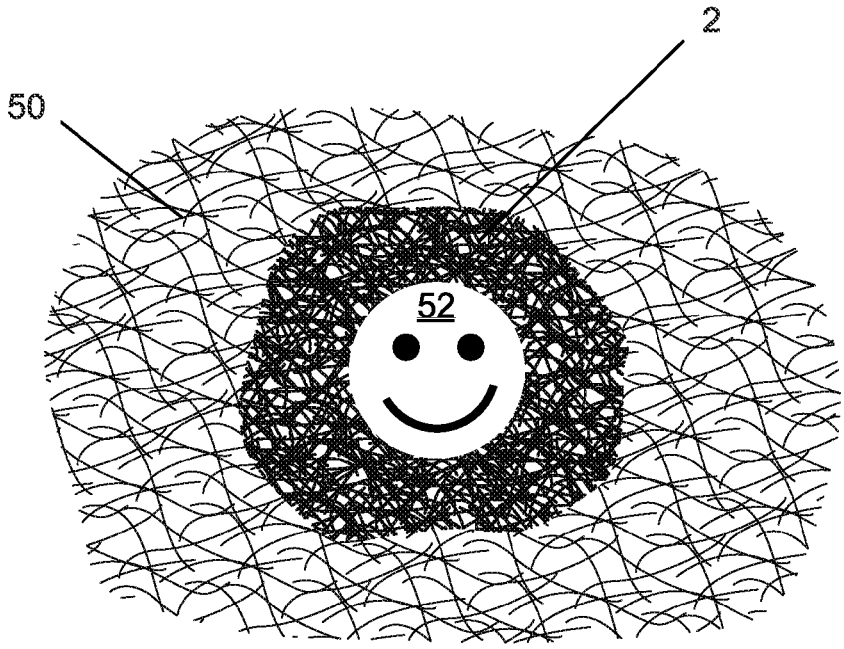
FIG. 2 is a top view of an implementation of a sprinkler head cover installed over a sprinkler head included in a grassy area.

Implementations of sprinkler head covers 2, 22, and 28 generally do what the name states—they fit into the holes or indentations in a grassy surface to bring the level of the hole or indentation up to the approximate level of the grassy surface. Particular implementations may also function to provide a firm surface, allowing a person to walk over the top of the sprinkler head without feeling substantial "give" or flexion when the person's foot is located on top. Referring to FIG. 2, a grassy surface 50 is illustrated with a sprinkler head cover 2 placed over a sprinkler head included in the surface 50. As can be seen from the picture, the visible artificial turf portion of the sprinkler head cover is substantially coextensive with the area of the hole (i.e., the hole is not visible beneath the cover). This grassy surface 50 could be in a lawn or the fairway of a golf course hole. When the grassy surface 50 is the fairway of a golf course hole, a hole containing a sprinkler head may be adjacent to the edge of the putting green. Because the putting green is designed for precision ball play, the design of the hole and the watering system generally avoids placing sprinkler heads within the perimeter of the green itself. In order to water the green, however, sprinkler heads are often placed adjacent the perimeter of the green and are directed at the green.

Because the sprinkler heads are placed in a hole or indentation, a golf ball cannot be putted directly across the top of a conventional sprinkler head. If a golf ball on the fairway has the sprinkler head hole between it and the flagstick, the player is forced to chip or lay-up to attempt to get the golf ball over the sprinkler head hole. In addition, during driving and chipping that takes place during game play, a golf ball may land on top of the sprinkler head. Because conventional sprinkler heads are made of plastic or other materials and rest in a hole, the golf ball does not generally bounce off the sprinkler head in a stable, predictable manner when compared to bouncing off the fairway or green. Accordingly, conventional sprinkler heads and the holes in which they are located on a golf course hole are a hazard to the player who is playing the hole. If the hole or indentation containing the sprinkler head is brought up to the approximate height of the surrounding grass using a sprinkler head cover, however, the effect of the sprinkler heads can be reduced, and putting over the top of a sprinkler head may be possible. In addition, if the structure of the sprinkler head cover is properly designed, particular implementations may allow for a more predictable bounce off the top of the sprinkler head cover which may approximate that off the fairway.

Implementations of sprinkler head covers 2, 22, and 28 may utilize various implementations of a method of covering a sprinkler head. The method may include opening a reclosable opening in a bag included in a sprinkler head cover which also includes a stiffener coupled to a backing of an artificial turf portion where the bag is coupled to the stiffener. The method may also include placing fill material within the bag, closing the reclosable opening, and placing the bag within a hole containing a sprinkler head in a retracted position where the hole is included in a grassy surface. Particular implementations of the method may also include adjusting a height of the artificial turf portion above the sprinkler head by removing the sprinkler head cover from the hole, opening the reclosable opening, adding additional or removing fill material from the bag, closing the reclosable opening, and replacing the bag within the hole. A wide variety of fill materials may be used to provided weight to implementations of sprinkler head covers, including, by non-limiting example, sand, lead shot, steel shot, gravel, or any other flowable material that can be contained within a bag.

In various method implementations, the method may also include engaging one or more spikes included in the sprinkler head cover with soil around the sprinkler head. In other implementations, the method may include adjusting the position of the one or more spikes by sliding the one or more spikes away or toward an outer edge of the sprinkler head cover where the one or more spikes are slidably engaged between the stiffener and a spike retainer coupled to the stiffener. Any of the various spike retainer implementations and spike implementations disclosed herein may be utilized. The method may also include adjusting a height of the artificial turf portion above the sprinkler head by pressing downwardly on the sprinkler head cover to push the one or more spikes into the soil until the artificial turf portion is substantially at the level of grass surrounding the sprinkler head. In these implementations, the sprinkler head cover may not include a bag at all, but may just use spikes to level and hold the sprinkler head cover to the earth.

Referring to FIG. 2, in various method implementations (and in various implementations of sprinkler head covers), the method may include applying an image 52 to the plurality of fibers included in the artificial turf portion of the sprinkler head cover. This may be accomplished in a variety of ways, including, by non-limiting example, spray painting, stencil painting, roller painting, applying decals, or any other method of creating an image on the plurality of fibers. The images created may be trademarks, company logos, pictures, names of particular locations (such as country clubs), advertising materials, or decorative images. A wide variety of image types may be utilized depending upon the venue in which a particular sprinkler head cover is located.

In places where the description above refers to particular implementations of sprinkler head covers and related method implementations, it should be readily apparent that a number of modifications may be made without departing from the spirit thereof and that these implementations may be applied to other sprinkler head covers and related method implementations.

The invention claimed is:

1. A sprinkler head cover comprising:

an artificial turf portion comprising a backing;

a stiffener coupled to the backing; and a bag coupled to the stiffener, the bag comprised of a flexible material, the bag having at least one reclosable opening therein configured to be closed by bringing two or more edges of the flexible material together;

wherein the bag is configured to receive a quantity of fill material when the at least one reclosable opening is opened and to retain the quantity of fill material within the bag when the at least one reclosable opening is closed; and wherein the artificial turf portion comprises at least one curved edge, the curved edge curving in a plane that is substantially parallel with a longest length of the artificial turf portion.

2. The sprinkler head cover of claim 1, further comprising one or more spikes slidably retained between the stiffener and a spike retainer coupled to the stiffener, the one or more spikes extending through one or more spike openings in the bag.

3. The sprinkler head cover of claim 1, wherein the at least one reclosable opening comprises a fastener selected from the group consisting of hook and loop fasteners, a zipper, one or more snaps, and one or more buttons.

4. The sprinkler head cover of claim 1, wherein the artificial turf portion further comprises a plurality of fibers coupled to the backing, the plurality of fibers further comprising an image thereon.

5. The sprinkler head cover of claim 1, wherein the fill material is selected from the group consisting of sand, lead shot, steel shot, and gravel.

6. A sprinkler head cover comprising:

an artificial turf portion comprising a backing, the artificial turf portion configured to be substantially coextensive with an area of a hole in a grassy area;

a stiffener coupled to the backing on a first side of the stiffener; and a bag coupled to the stiffener on a second side of the stiffener, the bag having at least one reclosable opening therein, the at least one reclosable opening formed by two or more edges in material comprised in the bag, the reclosable opening configured to be closed by bringing the two or more edges together;

wherein the stiffener is located between the backing and the bag and comprises an outermost perimeter that is substantially the same as an outermost perimeter of the backing.

7. The sprinkler head cover of claim 6, further comprising one or more spikes slidably retained against the second side of the stiffener and against a spike retainer coupled to the stiffener, the one or more spikes extending through one or more spike openings in the bag and configured to engage with soil around the area of the hole.

8. The sprinkler head cover of claim 6, wherein the at least one reclosable opening comprises a fastener selected from the group consisting of hook and loop fasteners, a zipper, one or more snaps, and one or more buttons.

9. The sprinkler head cover of claim 6, wherein the artificial turf portion further comprises a plurality of fibers coupled to the backing, the plurality of fibers further comprising an image thereon.

10. The sprinkler head cover of claim 6, wherein the bag is configured to receive a fill material selected from the group consisting of sand, lead shot, steel shot, and gravel.

11. A method of covering a sprinkler head comprising:

opening a reclosable opening in a bag comprising a flexible material by decoupling two or more edges of the flexible material, wherein the bag is included in a sprinkler head cover, the sprinkler head cover comprising a stiffener coupled to a backing of an artificial turf portion, the bag coupled to the stiffener;

placing fill material within the bag;

closing the reclosable opening by recoupling the two or more edges of the flexible material together; and placing the bag within a hole containing a sprinkler head in a retracted position where the hole is included in a grassy surface;

wherein a perimeter of the artificial turf portion forms an elliptical shape.

12. The method of claim 11, further comprising adjusting a height of the artificial turf portion above the sprinkler head by removing the sprinkler head cover from the hole, opening the reclosable opening, adding additional or removing fill material from the bag, closing the reclosable opening, and replacing the bag within the hole.

13. The method of claim 11, further comprising engaging one or more spikes included in the sprinkler head cover with soil around the sprinkler head.

14. The method of claim 13, further comprising adjusting a position of the one or more spikes by sliding the one or more spikes away or toward an outer edge of the sprinkler head cover, the one or more spikes slidably engaged between the stiffener and a spike retainer coupled to the stiffener.

15. The method of claim 13, further comprising adjusting a height of the artificial turf portion above the sprinkler head by pressing downwardly on the sprinkler head cover to push the one or more spikes into the soil until the artificial turf portion is substantially at the level of grass surrounding the sprinkler head.

16. The method of claim 11, further comprising applying an image to a plurality of fibers included in the artificial turf portion.

* * * * *